US005852339A

United States Patent [19]

Hamilton et al.

[11] Patent Number: 5,852,339

[45] Date of Patent: Dec. 22, 1998

[54] AFFORDABLE ELECTRODELESS LIGHTING

[75] Inventors: Robin E. Hamilton, Millersville; Paul G. Kennedy, Grasonville; Raymond A. Smith, Severna Park, all of Md.

[73] Assignee: Northrop Grumman Corporation, Los Angeles, Calif.

[21] Appl. No.: 878,441

[22] Filed: Jun. 18, 1997

[51] Int. Cl.[6] ..... H01J 65/04; H01J 61/00

[52] U.S. Cl. ..... 313/11; 313/34; 313/35; 313/45; 313/607; 313/234; 315/248

[58] Field of Search ..... 313/11, 12, 34, 313/35, 45, 46, 607; 315/234, 248, 344

[56] References Cited

U.S. PATENT DOCUMENTS

| | | | |
|---|---|---|---|
| 3,366,171 | 1/1968 | Scharli . | |
| 3,517,730 | 6/1970 | Wyatt . | |
| 5,000,252 | 3/1991 | Faghri . | |
| 5,006,752 | 4/1991 | Eggink et al. | 313/161 |
| 5,168,926 | 12/1992 | Watson et al. . | |
| 5,349,271 | 9/1994 | van Os et al. . | |
| 5,396,947 | 3/1995 | Itoh . | |
| 5,498,937 | 3/1996 | Köber et al. . | |
| 5,587,608 | 12/1996 | Meng . | |

OTHER PUBLICATIONS

"Heat Pipes For Electronics Cooling Applications", Scott D. Garner P.E., *Electronics Cooling,* vol. 2, No. 3, Sep., 1996, pp. 18–23.

*Primary Examiner*—Nimeshkumar Patel
*Attorney, Agent, or Firm*—Walter G. Sutcliff

[57] ABSTRACT

An electrodeless light bulb assembly having a standard light bulb base located at one end of an extruded cylindrical heat sink including a set of elongated fins extending radially outward from an annular inner body portion. An electrodeless light bulb, excitation coil, and transparent cover for the bulb are located at the other end of the heat sink. A solid state electrodeless lamp driver circuit is thermally coupled to the heat sink and is located in a hollow inner space region formed by the inner body portion. The annular inner body portion also includes at least one but preferably a plurality of boiler/condenser heat pipes located around its periphery for thermally coupling the heat from excitation coil and the driver to the fins where heat is transferred to the air via natural convection. The excitation coil can be formed from a length of conventional electrical conductor or it can be formed from a length of heat pipe connected at one end to the driver and at the other end to the heat sink.

20 Claims, 2 Drawing Sheets

FIG. 5
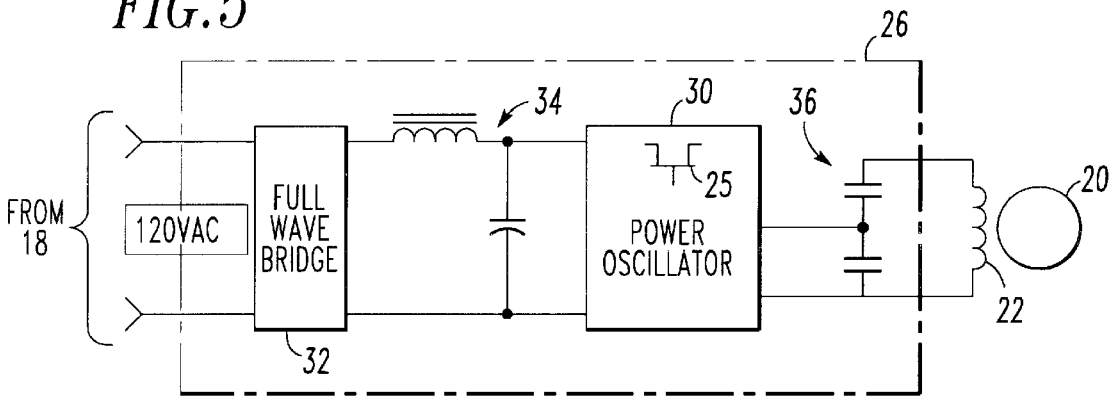
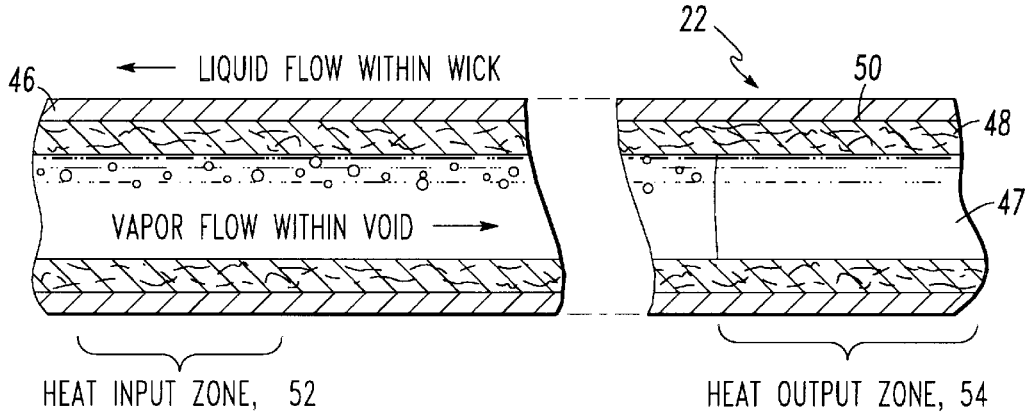
FIG. 6
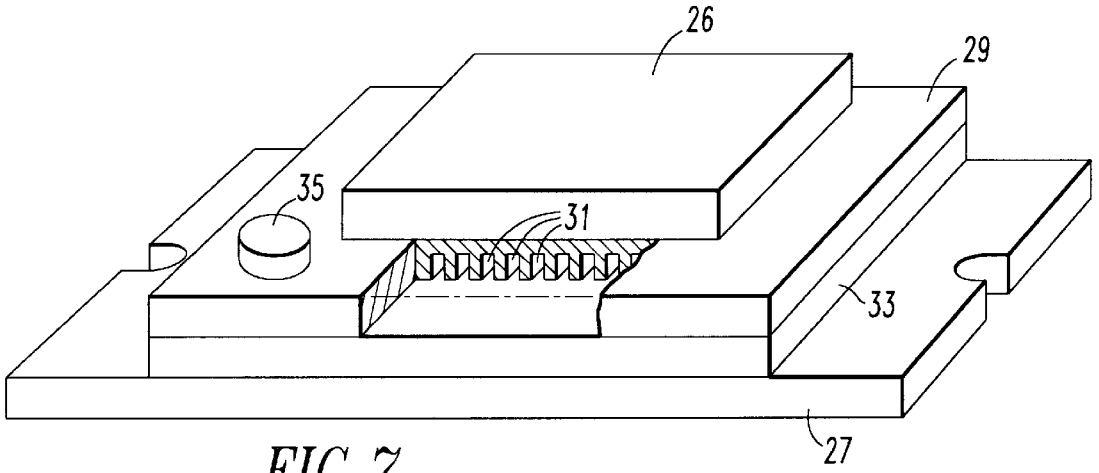
FIG. 7

AFFORDABLE ELECTRODELESS LIGHTING

CROSS REFERENCE TO RELATED APPLICATIONS

This application is related to the following U.S. patent applications:

- U.S. Ser. No. 08/863,052 (BD-95-150), entitled, "A Novel RF Source For Exciting Electrodeless Lamps", Edward H. Hooper, filed on May 23, 1997;
- U.S. Ser. No. 08/969,248 (BD-95-204), entitled, "An Integral Igniter For Electrodeless Lamps", Raymond A. Smith et al, filed on Nov. 13, 1997;
- U.S. Ser. No. 08/969,271 (BD-96-020), entitled, "Precession of the Plasma Torus in Electrodeless Lamps by Non-Mechanical Means", Paul G. Kennedy et al, filed on Nov. 13, 1997;
- U.S. Ser. No. 08/969,272 (BD-96-029), entitled, "Pulsed Power RF Driver for Low Power Electrodeless Lamps", Raymond A. Smith et al, filed Nov. 13, 1997;
- U.S. Ser. No. 08/858,419 (BD-96-088), entitled, "Solid State RF Light Driver For Electrodeless Lighting", Alfred W. Morse, filed on May 19, 1997, now allowed;
- U.S. Ser. No. 08/877,848 (BD-96-139), entitled "RF Coil/Heat Pipe For Solid State Light Driver", Robin E. Hamilton et al, filed on Jun. 18, 1997, now allowed;
- U.S. Ser. No. 08/681,207 (WE58,813), entitled "Microchannel Cooling High Power Semiconductor Devices", Robin E. Hamilton et al, filed on Jul. 22, 1996, now allowed; and
- U.S. Ser. No. 08/681,344 (WE58,811), entitled "Closed Loop Liquid Cooling Within RF Modules", Robin E. Hamilton et al, filed on Jul. 22, 1996, now abandoned and refiled as Ser. No. 08/970,385.

These applications are assigned to the assignee of the present invention and are meant to be incorporated herein by reference.

BACKGROUND OF THE INVENTION

1. Field of the Invention

This invention relates generally to high intensity light generation and more particularly to an improved electrodeless lamp assembly including apparatus for the excitation of an electrodeless light bulb.

2. Description of Related Art

There has been a long term need for improved light sources for lighting applications such as projection TV, projection display and institutional, commercial and industrial lighting. The key parameters sought are efficiency, light quality, reliability and low cost. While various light sources have been developed in the past which address various aspects of these needs, to date, however, no light source has been found to be optimum in all respects, and therefore a relatively large commercial market awaits new techniques which offer significant improvements.

One such light source comprises an RF excited electrodeless light bulb which comprises a closed transparent glass sphere filled with a proprietary gas. Typically, the bulb contains an inert gas, such as argon, and an element from Group VI-A of the Periodic Table of elements, such as sulfur. When the gas is excited by a high RF field, it glows with an intense white light. The ratio of light output per unit input power is considerably higher than other types of light sources and the quality of the light is unsurpassed for its similarity to bright sunlight. Because the bulb is hermetic with no electrodes, its cost is minimal and its reliability and useful life are exceptional.

Excitation of such an electrodeless bulb can be accomplished by coupling RF energy to the bulb by several known techniques, namely: capacitive coupling, inductive coupling, and RF/microwave cavity coupling. Capacitive coupling is accomplished by placing the electrodeless lamp between two surfaces across which an RF voltage is applied. Inductive coupling is implemented by inserting the electrodeless bulb within the turn(s) of a coil across which the RF excitation source is applied. These two techniques are generally utilized at frequencies up to a few hundred MHz. RF or microwave cavity coupling is effective at frequencies from several hundred MHz up to a few GHz. In general, the coupling efficiency increases as the excitation frequency increases.

While magnetrons are known to have been utilized to energize electrodeless bulbs, such devices cannot provide the necessary reliability to match or complement the life of the electrodeless bulb (in the order of 40,000 hours), whereas well designed semiconductor circuits can provide a sufficiently high reliability to take full advantage of the bulb's relatively long operational life.

When one evaluates the cost of solid state sources against the excitation frequency, it is apparent that the cost of the source hardware generally increases as the excitation frequency increases. The primary cost driver in the source is the transistor choice. At the lowest frequencies, low cost switching transistors can be applied. As the excitation frequency increases to hundreds of MHz, the transistor structure is more complex, more difficult to manufacture, and therefore is more expensive. As the frequency is increased into the low GHz range (13 GHz), the cost of the transistor increases dramatically.

A relatively low cost driver comprised of a transformerless power oscillator using a silicon carbide Static Induction Transistor powered directly off of a rectified AC line and operating at a frequency of about 2450 MHz is disclosed in the above cross-referenced related U.S. application Ser. No. 08/858,419 (BD-96-088). Such circuitry eliminates the conventional approach of a frequency source followed by a driver stage followed by a power amplifier stage and results in a much simpler hardware implementation because the parts count is substantially less.

Furthermore, the power oscillator can be modulated (pulsed) as taught in the above cross-referenced U.S. application Ser. No. 08/969,272 (BD-96-029).

In the above cross-referenced related U.S. application Ser. No. 08/877,848 (BD-96-139), a heat pipe/excitation coil arrangement is formed so as to encircle the light bulb. One end of the coil is driven by a solid state driver while the opposite end is connected back to an RF ground. The coil itself is comprised of a simple, low cost heat pipe formed into a coil shape and provides efficient transport of heat from the coil and light bulb to a finned heat sink cooled by natural convection. The heat pipe is made from a cylindrical copper tube. The internal walls of the tube are lined with a capillary structure or wick. The heat pipe is evacuated and charged with water prior to being sealed at an internal pressure set to the vapor pressure of the fluid. As heat is generated along the length of the heat pipe (the evaporator) wrapped around the electrodeless bulb, water is vaporized, creating a pressure gradient within the pipe. This gradient forces the vapor to flow along the inside cavity of the pipe to the cooler heat sunk end, where it condenses, giving up its latent heat of vaporization. The working fluid is then returned to the evaporator by the capillary forces in the wick. Essentially, heat is transferred through the heat pipe to the finned heat sink with a two phase system that results in very little temperature gradient through the coil's length.

While several known techniques are known for cooling semiconductor devices, typically high powered transistors such as by forced air cooling, cross referenced related applications Ser. Nos. 08/681,207 and 08/681,344 (WE58,813 and WE58,811) disclose the concept of microchannel cooling of such devices. Microchannel cooling utilizes forced convection with dense fluids in very small channels located as close as possible to the heat source. A microchannel heat sink is comprised of a series of parallel rectangular channels formed in a solid material of high thermal conductivity. The rectangular sections of the material separating the channels act as fins. When a heat generating device(s) is thermally bonded to the top of the heat sink or formed directly on the heat sink itself, the heat generated in the device is transferred through the solid upper portion of the heat sink and the channels by conduction, and is then transferred to the coolant primarily by convection. Typical microchannel sizes are as small as 0.001 inches by 0.004 inches. The use of very narrow channels enhances heat transfer in two ways. First, narrow channels can be closely spaced, giving a large number of fins with a combined surface area much greater than the "footprint" of the heat sink. Secondly, the small hydraulic dimensions of the narrow passages (approximately twice the channel width) result in relatively high convection heat transfer coefficients with laminar flow. Since the thermal conductance of a heat sink is proportional to the product of the convective heat transfer coefficient and the surface area, small channels allow an increase in the maximum power density for a given operating temperature.

SUMMARY

Accordingly, it is an object of the present invention to provide an improvement in electrodeless lighting systems.

It is another object of the invention to provide an improvement in the apparatus used to excite as well as cool an electrodeless light bulb assembly.

It is yet another object of the invention to provide an electrodeless light bulb assembly which can act as a direct replacement for standard light bulbs.

The foregoing and other objects are achieved by an electrodeless light bulb assembly having a standard light bulb base located at one end of an extruded cylindrical heat sink including a set of elongated fins extending radially outward from an annular inner body portion. An electrodeless light bulb, excitation coil and cover for the bulb are located at the other end of the heat sink. A solid state driver circuit is thermally coupled to the heat sink and is located in a hollow inner space formed by the inner body portion. The annular inner body portion also includes a plurality of boiler/condenser heat pipes located around its periphery for thermally coupling the heat generated in the driver as well as the excitation coil to the fins where heat is transferred to the air via natural convection. In the preferred embodiment of the invention, the excitation coil also comprises a length of heat pipe connected at one end to the driver circuit and at the other end to the finned heat sink. As heat is generated in the vicinity of the zone of the heat pipe(s), water vapor within the pipe is vaporized creating a pressure gradient. This forces the vapor to flow along the inside cavity of the respective heat pipe to a cooler zone end where it condenses, giving up its latent heat evaporization. The condensate is then returned back to the heated zone where the process repeats itself. In one preferred configuration of the heat pipe, the internal wall of the heat pipe is lined with a capillary structure or wick, so that the condensate is returned to the heated zone of the structure by capillary forces in the wick.

Further scope of applicability of the present invention will become apparent from the detailed description provided hereinafter. It should be understood, however, that the detailed description and specific example, while indicating the preferred embodiment of the invention, is given by way of illustration only, since various changes and modifications coming within the spirit and scope of the invention will become apparent to those skilled in the art from a reading of the detailed description to follow.

BRIEF DESCRIPTION OF THE DRAWINGS

The present invention will become more fully understood when considered together with the accompanying drawings which are provided by way of illustration only, and thus are not limitative of the invention, and wherein:

FIG. 5 is an electrical block diagram generally illustrative of the driver circuit for exciting the electrodeless lamp shown in FIG. 1;

FIG. 6 is a partial longitudinal cross-sectional view of a heat pipe type structure; and FIG. 7 is a perspective view generally illustrative of a microchannel cooling structure utilized in connection with the driver circuit shown in FIG. 5.

DETAILED DESCRIPTION OF THE INVENTION

Figure 1:
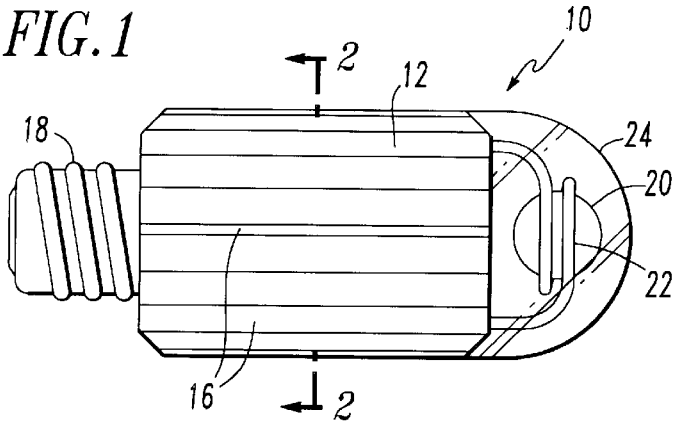
FIG. 1 is a side elevational view generally illustrative of an electrodeless light bulb assembly in accordance with the preferred embodiment of the invention.
Figure 2:
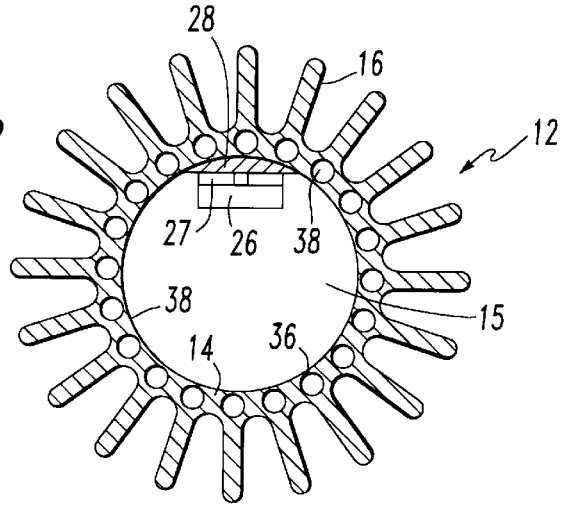
FIG. 2 is a transverse cross sectional view of the embodiment shown in FIG. 1 taken along the lines 2—2 thereof.

Referring now to the drawings wherein like reference numerals refer to like parts throughout, FIGS. 1 and 2 disclose an electrodeless lamp assembly 10 which is adapted to be a direct replacement for a standard incandescent light bulb. Reference numeral 12 denotes an extruded cylindrical heat sink body having high conducting properties including an annular inner core portion 14 defining an inner space region 15 from which a plurality of radially extending fins 16 extend. A standard light bulb base 18 is secured to one end of the heat sink 12, while an electrodeless light bulb 20 and an RF excitation coil 22 therefor are mounted at the other end of the heat sink 12. A transparent cover 24 is fashioned around both the light bulb 20 and the excitation coil 22.

Figure 3:
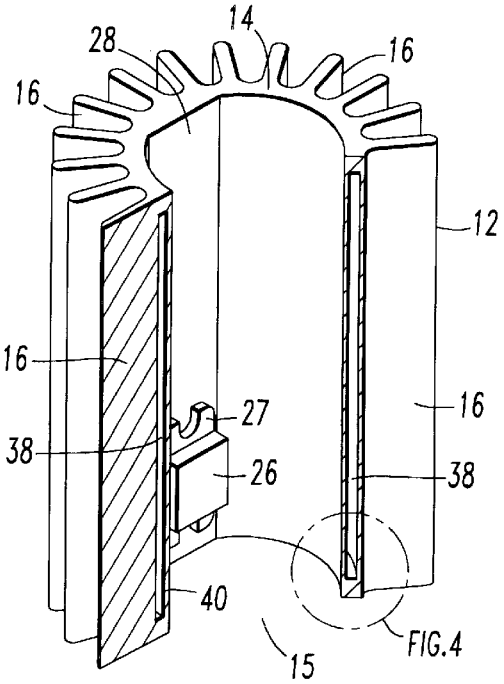
FIG. 3 is a partial cut-away perspective view of the heat sink for the embodiment shown in FIG. 1.

The electrodeless light bulb 20 comprises a device which is well known to those skilled in the art and emits an extremely intense light when excited by an RF field. The excitation coil 22 is connected at one end to the core portion 14 of the heat sink 20, while its opposite end is connected to the output of a solid state driver 26 which is mounted on an inside surface 28 of the heat sink 12 by a metal flange 27 as shown in FIG. 3.

The driver circuitry is broadly disclosed by the electrical circuit diagram shown in FIG. 5 and comprises an exciter circuit such as taught in the above cross-referenced application, U.S. Ser. No. 08/858,419 (BD-96-088). As shown in FIG. 5, the driver circuit 20 is comprised of a solid state power oscillator 30 powered by a full wave AC-DC bridge 32 which receives 120 VAC from the light base 18 (FIG. 1). An inductor/capacitor filter circuit 34 acts to filter the DC power applied to the oscillator 30. As noted above, the power oscillator 30 comprises a solid state circuit represented by the semiconductor device 25 which is operable to generate an RF excitation signal of about 2450 MHz which is coupled to the bulb's excitation coil 22 by means of a matching network 36.

This now leads to a consideration of the means employed in the subject invention for dissipating the heat from both excitation coil 22 and the driver 26. The extruded heat sink 12 is designed to conduct waste heat from the driver 26 and lamp 20 to the ambient via natural convection.

Figure 4:
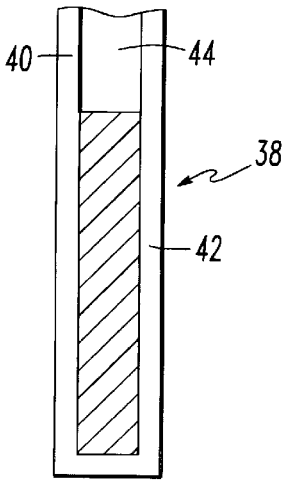
FIG. 4 is a fragmentary cross-sectional view of a portion of a boiler/condenser element located in the heat sink shown in FIG. 3.

As shown in FIG. 2, the heat sink 12 includes a plurality of boiler/condenser elements 38 dispersed around the core portion 14. As further shown in FIGS. 3 and 4, each of the boiler/condenser elements 38 is comprised of an elongated passage 40 having a relatively small cross sectional dimension and which is closed off at the ends. The passages 40 are evacuated and charged with a working fluid 42 such as water. As heat is generated, for example, by the driver unit 26 located in the lower portion of the heat sink 12 as shown in FIG. 3, the water 42 in close proximity to the driver 26 is vaporized within the passage 40, generating a pressure gradient within the evacuated space 44 (FIG. 4). This gradient forces the vapor to flow up inside the space 44 to a cooler region above the driver 26 where it condenses, giving up its latent heat evaporation. The water condensate 42 is then returned to the lower portion of the cavity by the natural forces of gravity.

In most applications, orientation does not present a problem. However, when desirable, a wicking action can be employed for returning the condensate as in a conventional heat pipe. Such a configuration is shown in FIG. 6 which, in the preferred embodiment of the invention, also comprises the construction of the excitation coil 22. As shown in FIG. 6, reference numeral 46 denotes a section of metal tubing having a layer of wicking material 48 on the inner wall surface 50. The section of tubing 46 is evacuated and charged with a liquid 47, typically water, as before. In a conventional heat pipe, the working fluid, e.g. water, is vaporized at a heat input zone 52 where it flows to a heat output zone 54 where it condenses and returns back to the heat input zone 50 by means of the wicking material 48. Thus heat can be transferred from the driver 26 or the excitation coil/heat pipe 22 through the working fluid and distributed across the heat sink fins 16 in a two phase system that results in very little temperature gradient. Heat is transferred from the fins 16 to the air via natural convection. The boiling/condensation concept is particularly suited to driver configurations which include silicon carbide transistors, where transistor base temperatures in excess of the boiling point of water (100° C.) may be encountered.

When excited, the surface of the electrodeless bulb 20 can heat up to temperatures in the range of 500° C.–800° C. Thus while the excitation coil 22 can simply be a metal coil for certain applications, in the preferred embodiment of the present invention, the excitation coil 22 is configured in the form of a heat pipe having a mid-section wound in the form of a coil.

Thus the excitation coil 22 not only acts as a means by which an RF field is generated and applied to the bulb 20, it also effectively removes a portion of the heat radiated from the bulb 20 as well as the heat generated along the length of the coil 22 and transfers it to the body of the heat sink 12 where the heat is dissipated by the fins 16. In such an arrangement, the heat sink 12 additionally acts as an RF ground for the RF excitation coil 22 which has one end connected to the output of the driver, and wherein the other end is connected, for example, to the core portion 14 of the heat sink 12.

In the above-referenced related applications Ser. No. 08/681,207 (WE58,813) and Ser. No. 08/681,344 (WE58, 811), there is disclosed the concept of microchannel cooling of high powered semiconductor devices such as silicon carbide transistors. This concept is also applicable to the subject invention, particularly as it relates to the driver circuitry 26. Accordingly and as shown in FIG. 7, the driver unit 26 is fabricated on a substrate 29 which includes a plurality of mutually parallel microchannels 31, which act as conduits for a liquid coolant, e.g. water. A member 33 is located between the substrate 29 and the mounting flange 27 for closing off the microchannels 31 along their length. The liquid coolant is supplied from and returned to a source, such as a self-contained miniature pump 35 which is coupled to the microchannels 31 by means of a pair of feed lines and coolant manifolds, not shown, formed in the substrate 29. A miniature pump suitable for this application is disclosed in a publication entitled "A New Micropump Principle Of The Reciprocating Type Using Pyramidic Micro Flow Channels As Passive Valves", T. Gerlach et al, *Journal of Micromachines and Microengineering,* 5 (1995), pp. 199–201. The microchannel cooling configuration of FIG. 7 comprises a closed loop system wherein heat generated by one or more semiconductor devices located in the driver unit 26 is transferred to the extruded heat sink 12 through the closure member 33 and mounting flange 27. When desirable, the source of the coolant can be located apart from the driver 26, such as on the body of the heat sink 12 itself.

Thus what has been shown and described is a simple, relatively low cost high intensity lighting system including an electrodeless bulb which provides a desired electrical performance while at the same time maintaining commercially acceptable operating temperatures.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

We claim:

1. An electrodeless light bulb assembly, comprising:

a heat sink including an inner body portion defining a hollow inner space region and a plurality of heat dissipating fins extending outwardly from said inner body portion;

a threaded type lamp base located at one end of the heat sink for connection to an external source of electrical power;

an electrodeless light bulb and excitation coil therefor located at the other end of the heat sink;

a transparent cover for protecting the light bulb and the excitation coil secured to said other end of the heat sink;

a driver circuit connected to the excitation coil for exciting the light bulb and being thermally coupled to the heat sink and being mounted thereon in said hollow inner space region of said inner body portion; and wherein said heat sink additionally includes at least one boiler/condenser element located interiorly of said inner body portion adjacent said hollow inner space region for transferring heat from said excitation coil and said driver circuit to said fins.

2. An electrodeless light bulb assembly according to claim 1 wherein said heat sink comprises a generally cylindrical body of material having relatively high heat conductive properties.

3. An electrodeless light bulb assembly according to claim 1 wherein said heat sink comprises an extruded heat sink body of a predetermined length dimension and wherein said inner body portion comprises an annular body portion.

4. An electrodeless light bulb assembly according to claim 3 wherein said at least one boiler/condenser element comprises an elongated evacuated closed passage charged with a working fluid.

5. An electrodeless light bulb assembly according to claim 4 wherein said working fluid comprises a liquid, and wherein said passage has a relatively small cross sectional dimension whereby vapor generated from said liquid when heated rises, giving up its latent heat of vaporization to said fins and thereafter condensing and falling back to its original position in the respective passage where a cycle of vaporization is repeated.

6. An electrodeless light bulb assembly according to claim 5 and wherein said at least one boiler/condenser element comprises a plurality of boiler/condenser elements located around the annular inner body portion and extending along the length dimension thereof.

7. An electrodeless light bulb assembly according to claim 6 wherein said liquid comprises water.

8. An electrodeless light bulb assembly according to claim 6 and additionally including wicking material in said passage.

9. An electrodeless light bulb assembly according to claim 6 wherein said fins are cooled by natural convection.

10. An electrodeless light bulb assembly according to claim 4 wherein said at least one boiler/condenser element comprises a heat pipe.

11. An electrodeless light bulb assembly according to claim 4 and wherein said coil comprises an RF coil having at least one turn wrapped around said electrodeless light bulb and having one end connected to an excitation signal generated by said driver circuit and the other end thereof connected to said heat sink, said heat sink being further comprised of electrically conductive material so as to provide an RF ground for said coil.

12. An electrodeless light bulb assembly according to claim 11 wherein said RF coil is constructed from a length of heat pipe whereby said coil operates not only to generate an electromagnetic excitation field for said light bulb, but also operates to transfer heat generated by said RF coil and heat radiated from said light bulb to said RF coil to said heat sink.

13. An electrodeless light bulb assembly according to claim 12 wherein said length of heat pipe is comprised of metal tubing having an inner wall surface including wicking material in contact with a working fluid.

14. An electrodeless light bulb assembly according to claim 13 wherein the working fluid comprises a liquid.

15. An electrodeless light bulb assembly according to claim 12 and wherein said driver circuit includes solid state circuit components.

16. An electrodeless light bulb assembly according to claim 15 wherein said solid state circuit components are located on a substrate thermally coupled to the heat sink.

17. An electrodeless light bulb assembly according to claim 16 wherein said substrate includes a plurality of passages for the flow of a coolant therethrough.

18. An electrodeless light bulb assembly according to claim 17 and additionally including means for circulating the coolant through said passages.

19. An electrodeless light bulb assembly according to claim 18 wherein said passages are connected to a source of coolant in a closed circulating loop.

20. An electrodeless light bulb assembly according to claim 17 wherein said passages comprise a set of microchannels formed in said substrate.

* * * * *